US008047042B2

(12) United States Patent
Sato et al.

(10) Patent No.: US 8,047,042 B2
(45) Date of Patent: Nov. 1, 2011

(54) PRESS FORGING METHOD

(75) Inventors: Toshihiko Sato, Chigasaki (JP); Yugo Takeuchi, Chigasaki (JP); Yasuo Yoshida, Quingdao (CN); Noboru Kakizawa, Chigasaki (JP); Takehiro Osugi, Chigasaki (JP); Takanori Yoshikawa, Chigasaki (JP)

(73) Assignee: Topy Kogyo Kabushiki Kaisha, Tokyo (JP)

( * ) Notice: Subject to any disclaimer, the term of this patent is extended or adjusted under 35 U.S.C. 154(b) by 927 days.

(21) Appl. No.: 11/987,272

(22) Filed: Nov. 28, 2007

(65) Prior Publication Data

US 2008/0141752 A1 Jun. 19, 2008

(30) Foreign Application Priority Data

Dec. 1, 2006 (JP) ..... 2006-325199
Feb. 7, 2007 (JP) ..... 2007-027452
Aug. 23, 2007 (JP) ..... 2007-216655

(51) Int. Cl.
*B21J 5/00* (2006.01)
*B21D 22/00* (2006.01)

(52) U.S. Cl. ..... 72/352; 72/356; 72/377

(58) Field of Classification Search ..... 72/352, 72/353.2, 353.6, 354.2, 357, 360, 354.6, 72/354.8, 355.2, 355.6, 359, 356, 358
See application file for complete search history.

(56) References Cited

U.S. PATENT DOCUMENTS 3,844,155 A * 10/1974 Bew et al. ..... 72/356
4,970,887 A 11/1990 Lorieux
6,151,948 A 11/2000 Ashworth et al.
7,454,941 B2 * 11/2008 Bergue et al. ..... 72/359
2004/0255637 A1 * 12/2004 Dohmann ..... 72/354.2

FOREIGN PATENT DOCUMENTS

JP 62-134101 A 6/1987
JP 62-286639 A 12/1987
JP 2006-231377 A 9/2006

OTHER PUBLICATIONS

Okumura et al., "Effect of Hot Rolling Conditions on Annihilation of Porosities in Continuous Casting Slabs", Tetsu to Hagane, 1980, pp. 33-42, vol. 2.

Nagumo et al., "Metallurgical Significance of Hot-Rolling of Continuously-Cast Steel on Steel Plate Quality", Seitatsu Kenkyu, 1982, pp. 140-148, vol. 309.

Japanese Industrial Standard, "Steel Forgings-General Technical Requirements", 1988, No. JIS G 0306, 27 pages, Japanese Standards Association.

* cited by examiner

*Primary Examiner* — Debra Sullivan
(74) *Attorney, Agent, or Firm* — Smith Patent Office

(57) ABSTRACT

The present invention is a press forging method by which porosities in a raw material are removed and mechanical properties such as ductility and toughness of a steel product are at a required level in a case that a steel ingot is treated as a raw material in press forging. A cylindrical steel ingot (a so-called "round billet") is set onto a die as a raw material, and, a forging process is applied to the steel ingot so that buckling of the steel is not generated during the forging process and that a reduction ratio and a forging ratio are more than predetermined values, respectively.

2 Claims, 8 Drawing Sheets

PRESS FORGING METHOD

BACKGROUND OF THE INVENTION

1. Field of the Invention

The present invention relates to a forging technology, and in particular, relates to a press forging technology wherein a round billet is used as a raw material.

2. Description of the Related Art

In a forging process of the prior art, a rolled steel is used as a raw material. In other words, in a forging process of the prior art, it requires a rolling process as a pretreatment process.

This is because, in rolled steel, porosities (blow holes and others) are removed in the rolling process.

Meanwhile, there are various kinds of production lines. For example, there is a production line wherein:

press forging machines suitable for press forging a steel ingot such as a round billet are provided;

a press forging process being directly applied to a steel ingot, which is treated as a raw material, is required; and a rolled steel is not processed.

However, in the case that a steel ingot is treated as a raw material, it is necessary to remove porosities found in the ingot. The reason is that, if there are porosities in the raw material, ductility and toughness of the steel products are deteriorated.

In the case that a steel ingot is treated as a raw material in the prior art, the conditions for applying force to a steel ingot and a forging ratio thereto are preliminarily determined and it is necessary to satisfy such conditions (the predetermined conditions).

Further, in the prior art, in the case that a steel ingot is treated as a raw material, killed steel has been used and portions, in which there are porosities and segregation, have been cut off.

If the raw material described above is used, the process of cutting off the portions, in which there are porosities and segregation, is required. Moreover, a yield of a steel product is deteriorated because of the cutting off of portions of the steel ingot.

As mentioned above, in the prior art, it is difficult to treat a steel ingot as a raw material, and a yield of a steel product is deteriorated. Therefore, in the case that a low-price steel ingot has been treated as a raw material, it is impossible to take advantage of the cost advantages of using "a low-price steel ingot".

The relationship between porosity or segregation and a reduction ratio or the like has heretofore been studied (for example, refer to 1) "Seitetsu Kenkyu," Vol. 309, "Metallurgical significance of hot-rolling of continuously-cast steel on steel plate quality" Authors: Michihiko Nagumo, Naoki Okumura, and Yasushi Inoue; 2) "Tetsu To Hagane," 1980, Vol. 2, "Influence of rolling conditions on the elimination of porosities in a continuously-cast slab" Authors: Naoki Okumura, Takeshi Kubota, Tadakatsu Maruyama, and Michihiko Nagumo; and 3) Japanese Standards Association, "JIS Handbook 2006, Steel I," pp. 548, "General rule on production, test, and inspection of forged steel product").

However, in the above-mentioned documents, there are no explanations for removing porosities and ameliorating ductility and toughness of a steel product in the case that a steel ingot is used as the raw material.

Further, in the prior art, there is a known technology for producing a thick steel plate having excellent internal properties. In such technology, there are steps for solidifying a steel in a mold, for removing the steel product from the mold as soon as the solidification of the steel, for hot-rolling the steel, and for applying light reduction to the steel in the thickness direction during the hot-rolling process.

However, such the prior art (Japanese Patent Publication No. S62-134101) does not disclose any ways for solving the above-mentioned problems.

SUMMARY OF THE INVENTION

The present invention has been proposed in consideration of the aforementioned problems in the prior art. An object of the invention is to provide a press forging method by which porosities in a raw material are removed and ductility and toughness of the steel product are at a required level in a case that a steel ingot is treated as the raw material in press forging.

A press forging method according to the present invention comprises the steps of:

setting a cylindrical steel ingot (so-called "a round billet" 1) onto a die (a lower die 22) as a raw material; and forging the steel ingot so that a buckling of the steel is not generated during the step of forging and so that a reduction ratio and a forging ratio are greater than predetermined values, respectively.

The phrase "press forging" in the present specification is used as a phrase including press forging in an axial direction (upset forging), press forging in a transverse direction (stretch forging), and a combination of press forging in the axial direction and press forging in the transverse direction.

Moreover, the definitions of the phrase "reduction ratio" and "forging ratio" are as follows:

"reduction ratio"=(the length of a raw material before forging/the length of a raw material after forging (shortened by forging)), and "forging ratio"=(the area of the cross section in the transverse direction of the raw material before forging/the area of the cross section in the transverse direction of the raw material after forging (reduced by forging)).

According to the above-mentioned definitions, both the "reduction ratio" and "forging ratio" have the values of more than 1.0.

Further, in the present invention, it is preferable that the forging process is applied to a steel ingot so as to make a ratio (L/D) of the total length to the diameter of the raw material controlled to 3 or less, and to make the reduction ratio controlled to 2.3 or more.

In this case, constructions corresponding to the phrase "a forging process is applied to a steel ingot so as to make the ratio (L/D) of the total length to the diameter of the raw material controlled to 3 or less" make an operation corresponding to the phrase "a buckling of the steel is not generated during the forging process" in the above invention. Also, constructions indicated in the phrase "a forging process is applied to steel ingot so as to make the reduction ratio controlled to 2.3 or more" correspond to the construction "a reduction ratio and a forging ratio are greater than predetermined values".

Furthermore in the present invention, it is preferable that a press forging in a transverse direction at a forging ratio of 1.2 or more is applied to a steel ingot, and thereafter, a press forging in an axial direction at a reduction ratio of 1.7 or more is applied to the steel ingot.

In this case too, although a raw material (the round billet 1) has a shape and a size which are not suitable for the above-mentioned press forging process, such a raw material can be deformed so as to have a shape and a size that is suitable for the above-mentioned press forging process.

The inventors, as a result of various studies, have found that, even if a cylindrical steel ingot (so-called "a round billet") is used as a raw material, the porosities in a forging product reduce to the same level as rolled steel by controlling a reduction ratio and a forging ratio to not less than predetermined values, respectively.

The present invention including the above-mentioned constructional elements has been established on the basis of such findings.

FIG. 7 is a graph indicating a relationship between a reduction ratio and a total hydrogen amount contained in a forging product.

As shown in FIG. 7, in a region where the reduction ratio is 2.3 or more, the total hydrogen amount, which is a parameter corresponding to amounts of porosities, is constant. That is, the total hydrogen amount, namely the porosity, is minimized at the reduction ratio of 2.3 and the total hydrogen amount, namely the porosity, does not reduce any more even when the reduction ratio is further increased.

Therefore, in the present invention, by applying forging at a reduction ratio of a predetermined value or more (concretely 2.3 or more), the porosities are removed to the lowest level, even if a press forging process is applied to a steel ingot as the raw material. As a result, ductility and toughness of a formed steel product are maintained to levels identical to those of a product produced by press forging process in which a rolled steel is treated as a raw material.

Further, even if a rolling process is not used in the present invention, the porosities are removed to a level identical to the case where a rolled steel is treated as the raw material. Hence, in the present invention, it is possible to produce forging products without using the rolling process. As a result, it is possible for the present invention to reduce costs for such a rolling process.

Furthermore, unlike the case of using a steel ingot as a raw material in the prior art in the present invention, the porosities are removed to a level identical to a case of treating a rolled steel as the raw material. Hence, it is not necessary to specify the region where the porosities exist nor to limit the useful portion. That is, it is possible to remarkably improve the yield of the raw material.

In addition, in the press forging method according to the present invention, it is sufficient for the reduction ratio to be maintained at 2.3 and the forging ratio to be maintained at 1.2, and thereafter, the reduction ratio is maintained at 1.7 (that is, the forging ratio is 1.2 and the reduction ratio is 1.7). A large reduction ratio (for example 4.0) as required in the prior art is not required any more. As a result, the costs for the forging processes can be reduced.

BRIEF DESCRIPTION OF THE DRAWINGS

It is submitted that the embodiments shown in the drawings are only examples and do not mean that the technological scope of the present invention is limited by such the embodiments.

DESCRIPTION OF THE PREFERRED EMBODIMENTS

Figure 1:
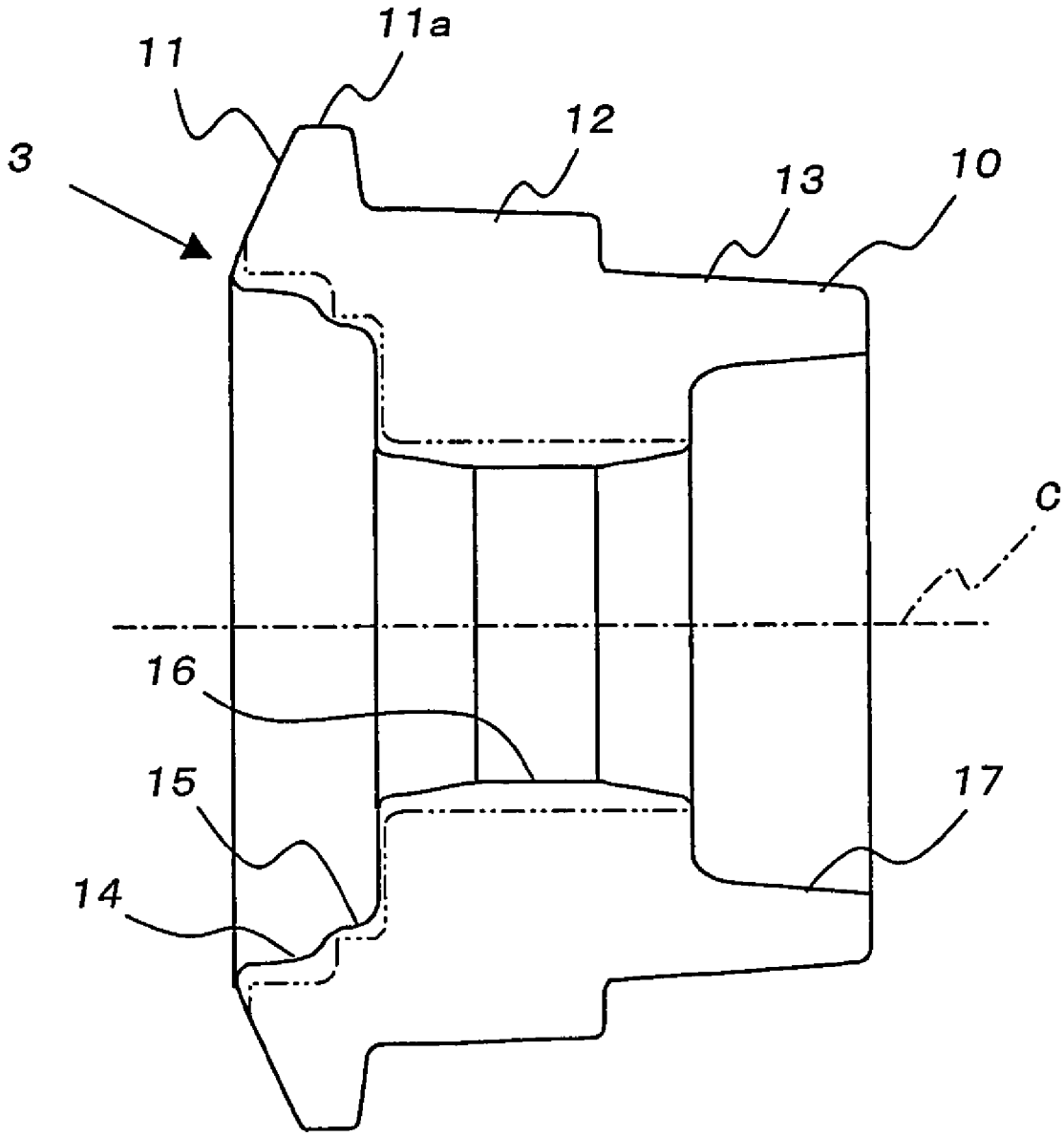
FIG. 1 is a sectional view of a roller produced by a forging process in an embodiment according to the present invention.

Embodiments of the present invention are explained in reference to the attached drawings as follows.

The embodiments shown in the drawings are based on the case where a cylindrical steel ingot called a round billet is treated as a raw material, and then a roller is produced.

In FIG. 1, a shape of a roller to be produced in the embodiments of the present invention is shown.

In FIG. 1, a roller 10 is formed in a cylindrical shape having steps. In the roller 10, both an outer circumference and an inner circumference are formed so as to have a plurality of steps.

In FIG. 1, the roller 10 has an obtusely tapered face 11 at an end thereof (shown on the left side). The outer circumference 11*a* of the tapered face 11 forms a part of the maximum diameter of the roller 10. The diameter of the part 11*a*, which is the maximum diameter, reduces toward another end of the roller 10 (shown on the right side) so as to form two steps. First, the diameter of the part 11*a* reduces to the diameter of an outer circumference surface 12, and then, the diameter of the part 12 reduces to the diameter of an outer circumference surface 13.

There are declines on the outer circumference surface 12 and the outer circumference surface 13, respectively.

In the case that the reduction ratio and the forging ratio are increased, if a ratio (L/D) of the total length to the diameter of a raw material is greater than 3, a buckling occurs during the forging process. In order to prevent such the buckling, it is necessary to set the value L/D to be 3 or less.

The roller 10 has a hollow center and inner diameter portions 14, 15, 16 and 17 in an inner circumference. The diameters of the inner diameter portions 14, 15, 16 and 17 are different each other. The inner diameter portion 16 has the smallest diameter along the center in the longitudinal direction.

There are declines on the inner diameter portions 14, 15, 16 and 17, respectively.

In FIG. 1, there is a portion shown with double-dotted lines. After press forging, such portion is cut off by means of a machining process. Thereafter, a heat treatment is applied, and then, the roller 10 is finished as a product. In other words, the roller 10 is produced by: forging a raw material; cutting a partially punched raw material 3 (refer to FIG. 5) into a shape shown by the double-dotted lines (in FIG. 1); and applying heat treatment.

In FIGS. 2 to 5, there are explanations relating to processes in the first embodiment. In other words, in FIGS. 2 to 5 processes of forming the roller 10 shown in FIG. 1 including the process of press forging and the process of punching are shown.

Figure 2:
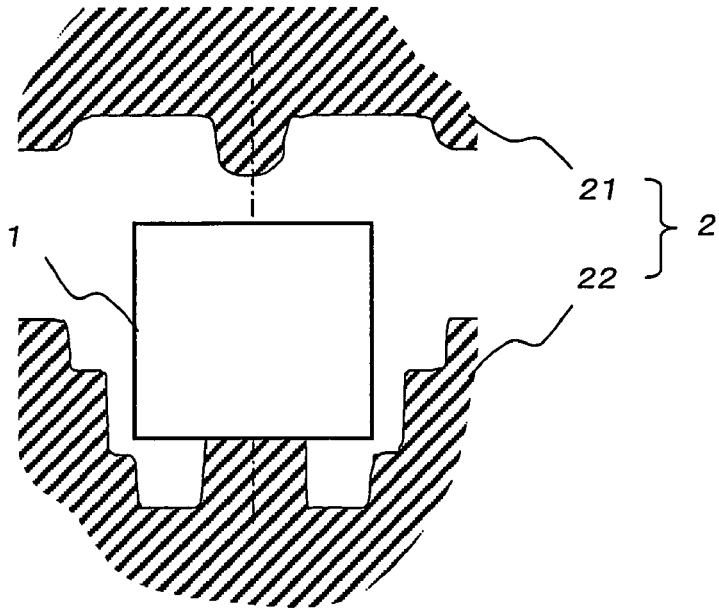
FIG. 2 is a view showing a round billet placed onto a lower die.

In FIG. 2, a round billet 1 as a raw material is placed onto a lower die 22. An upper die 21 is disposed at a position above the round billet 1. A forging die set 2 includes the upper die 21 and the lower die 22.

Figure 3:
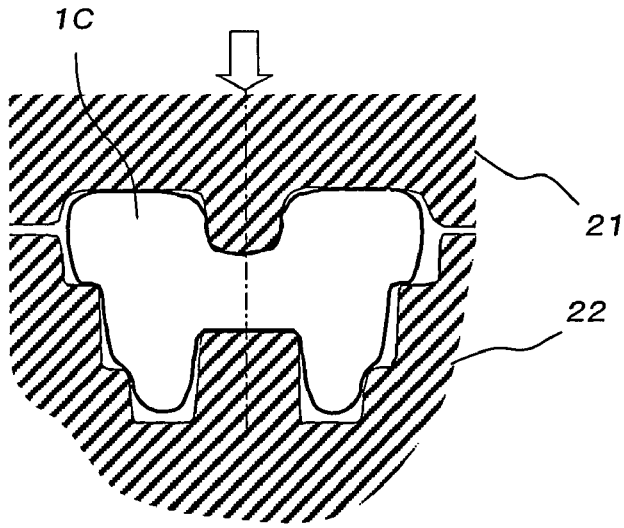
FIG. 3 is a view showing a situation in which the forging is carried out by pressing an upper die toward the lower die.

In FIG. 3, the press forging is carried out by pressing the upper die 21 toward the lower die 22. The round billet 1 having a cylindrical shape is plastic-deformed along the inner surfaces of the upper die 21 and the lower die 22 (refer to the character 1C).

Figure 4:
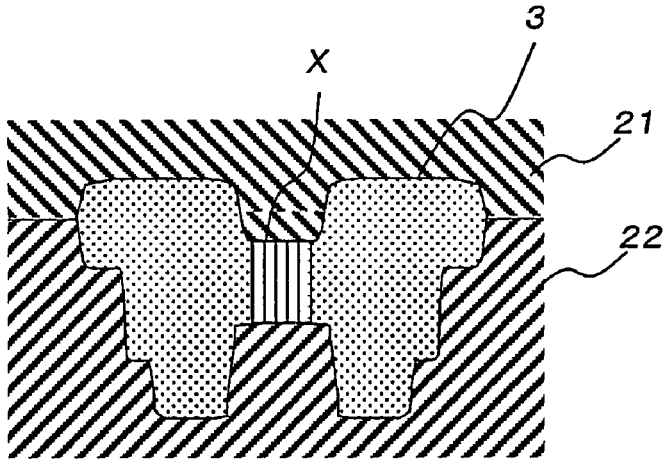
FIG. 4 is a view showing a situation in which the forging process is completed.

In FIG. 4, the upper die 21 is integrated with the lower die 22 and the round billet 1, which has cylindrical shape before the press forging process, and work 3 is formed into an intended shape through the press forging.

In the press forging shown in FIGS. 3 and 4, the reduction ratio is controlled so as to be at least 2.3, in the first embodiment.

In FIG. 4, a portion represented by a reference character X still remains in the formed raw material 3, and thus, the hollow shape as shown in FIG. 1 is not yet formed. Therefore, as shown in FIG. 5, a so-called "punching" process is carried out and the portion represented by the reference character X is removed.

Figure 5:
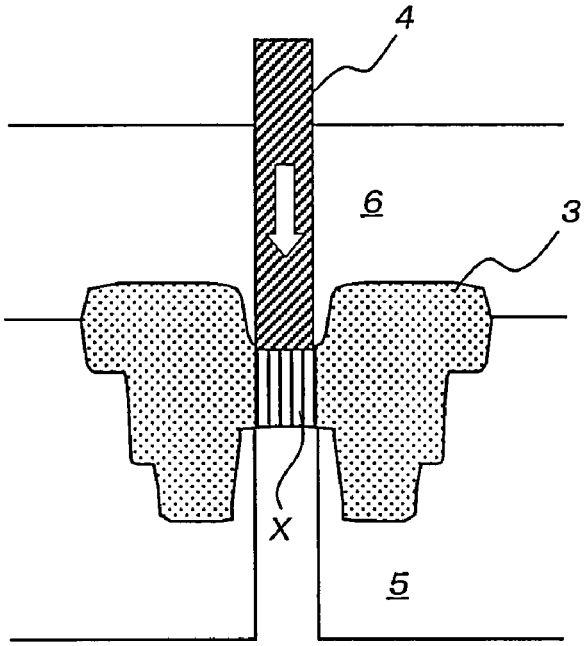
FIG. 5 is a view showing a punching process in the first embodiment.

In FIG. 5, a punching tool 4, a die 5, and a guide 6 along which the punching tool 4 slides, are shown.

After the punching is carried out as shown in FIG. 5, a machining process is carried out on the raw material 3 so as to cut or remove the portion shown with the double-dotted lines in FIG. 1.

In the case that a product having a complicated shape such as the roller 10 shown in FIG. 1 should be forged, it is difficult to define a reduction ratio merely from a shape of product after the forging process. In contrast, in the first embodiment, a round billet 1, the dimension or the mass of which has been adjusted beforehand, is conditioned or selected for the press forging as shown in FIGS. 3 and 4.

That is, in the first embodiment, a round billet 1, is conditioned or selected so as to satisfy either one of the following conditions (1) and (2):

(1) the reduction ratio is 2.3 or more, and (2) the forging ratio is 1.2 or more and the reduction ratio is 1.7 or more.

Figure 6:
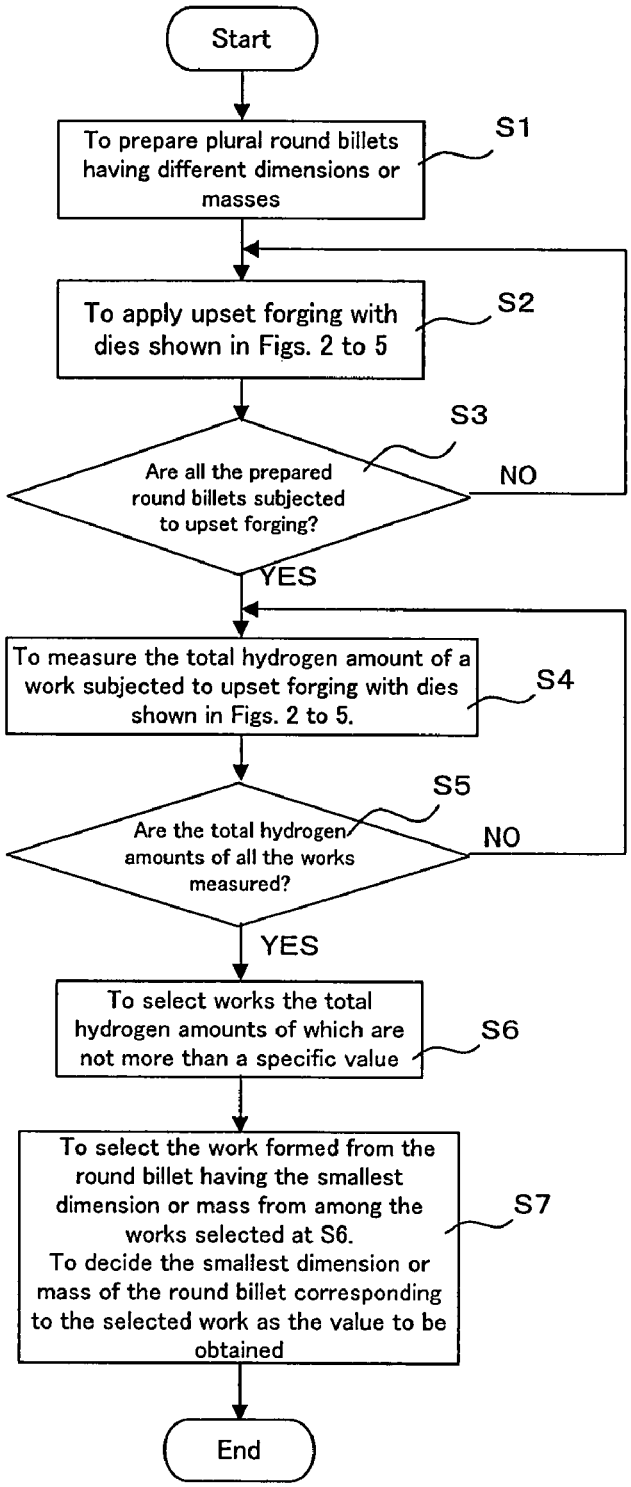
FIG. 6 is a flowchart showing a process of adjusting a dimension or a mass of a round billet.

In the process of adjusting the dimension or the mass of a round billet as shown in FIG. 6, the upper die 21 and the lower die 22 shown in FIGS. 2 to 5 are used.

On the basis of the flowchart shown in FIG. 6, the process of adjusting the dimension or the mass of the round billet is explained below.

In FIG. 6, a plurality of round billets having different dimensions or masses are prepared (Step S1).

A round billet 1 is placed onto the lower die 22 in the same manner as explained in reference with FIG. 2, and then, as shown in FIGS. 3 to 5, the round billet 1 is press-forged into the shape of the roller 10 shown in FIG. 1 (Step S2). At this stage, the dimension or the mass of the round billet 1 is set to a value adding a mass of flashes to the mass of the roller 10 shown in FIG. 1 and the value is thought to be appropriate.

Then, after completing press forging for one round billet 1, another round billet 1 having a dimension (or mass) different from the former round billet 1 is placed onto the lower die 22 and the press forging process is applied.

Likewise, the press forging process is applied to all of the prepared round billets 1 having different dimensions or masses from each other. At this stage, the dimensions or the masses of the round billets 1, each of which are treated as a raw material, are recorded respectively, corresponding to the press forged products 3. Each of these billets are in condition before being subjected to the cutting process as shown in FIG. 1.

At Step S3, it is judged whether or not the press forging process is applied to all of the prepared round billets 1. If there is a round billet 1 to which the press forging process is not applied among the prepared round billets 1 (NO at Step S3), the Steps S2 and S3 are repeated.

If the press forging process was applied to all of the prepared round billets 1 (YES at Step S3), the process goes to Step S4.

Then, with regard to all of the samples to which the press forging processes are applied at Step S2, the total hydrogen amounts are measured (Step S4).

Such measurement of a total hydrogen amount is described later with reference to FIG. 7.

At Step S5, it is judged whether or not the total hydrogen amounts of all of the raw materials 3 are completely measured. In the case that the total hydrogen amounts of all the raw materials 3 are completely measured (YES at Step S5), the process goes to Step S6. If there is a raw material (1A) where the total hydrogen amount has not been measured yet (NO at Step S5), the Steps S4 and S5 are repeated.

At Step S6, the total hydrogen amount of each of the raw materials 3 is compared with the specific value. Then, with regard to the raw material 3 having a total hydrogen amount being the specific value or less, the dimension or the mass of the (original) round billet 1 is determined as the dimension or the mass of a round billet 1 that is necessary to make a reduction ratio of 2.3 or more. That is, a round billet 1, which has a total hydrogen amount being the specific value or less after upset forging by means of the upper die 21 and the lower die 22, is selected as "a round billet 1 having the dimension or the mass which is adjusted beforehand so that the reduction ratio may be 2.3 or more".

It has already been clarified that a total hydrogen amount or porosity is almost constant in the case where the reduction ratio is 2.3 or more. Therefore, the minimum value of the dimension or the mass of the round billets 1, which corresponds to the raw materials 3 having a total hydrogen amount being the specific value or less, is determined as "the dimension or the mass of a round billet 1 being adjusted beforehand so that the reduction ratio may be 2.3 or more" (Step S7).

Figure 7:
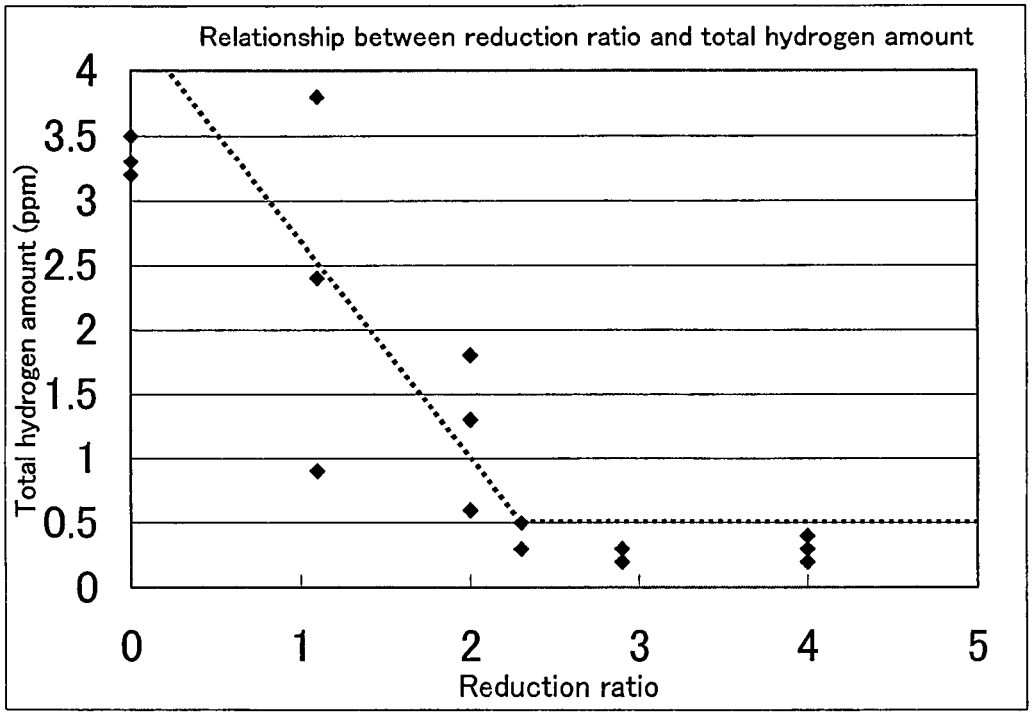
FIG. 7 is a characteristic graph showing a relationship between a reduction ratio and a total hydrogen amount.

FIG. 7 shows a relationship between a reduction ratio (a numerical value on the horizontal axis) and a total hydrogen amount (a numerical value on the vertical axis measured in parts per million "ppm").

In FIG. 7, the measurement results of the total hydrogen amounts of the plurality of raw materials 3 and the reduction ratios which are different from each other, are shown as the illustrated points.

Figure 8:
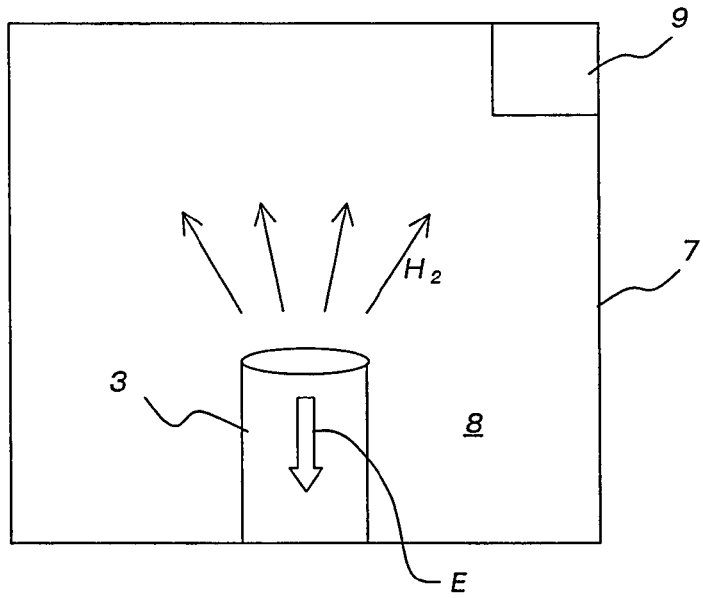
FIG. 8 is a schematic illustration of a device for measuring a total hydrogen amount.

The total hydrogen amount was measured by means of a measuring device 7 schematically shown in FIG. 8.

In FIG. 8, the raw material 3 is placed in a sealed space 8 in the interior of the measuring device 7. A predetermined amount of electric current (E) is fed to the raw material 3 through an electrode (not shown in the drawings). In this situation, the temperature of the space 8 is increased.

As the electric current E is fed and the temperature (the atmospheric temperature) in the space 8 is increased, hydrogen is discharged from the raw material 3. The amount of the discharged hydrogen is measured by means of a hydrogen-measuring device 9. The accumulated amount of the discharged hydrogen amount being measured by means of the hydrogen-measuring device 9 is defined as the total hydrogen amount in the raw material 3.

The "measurement of a total hydrogen amount" at Steps S5 and S4 in FIG. 6 are carried out in the same manner as explained in reference to FIG. 8.

Referring to FIG. 7, in a region that the reduction ratio is 2.3 or more, the total hydrogen amount does not reduce and is almost constant.

It is understood that a total hydrogen amount has a positive correlation with porosity (bubbles), and therefore, referring to FIG. 7, in a region that the reduction ratio is 2.3 or more, the porosity does not reduce and is almost constant. Also, in the case that the reduction ratio is 2.3, the porosity is nearly the minimum value.

According to studies by the inventors, it is estimated that if a reduction ratio is increased to more than 2.3, an amount of the reduction ratio contributes to grain refining.

By referring to FIG. 7, it is obvious that porosity reduces to the minimum value in the case that the press forging is carried out so as to make the reduction ratio equal to or greater than 2.3. In other words, by carrying out the press forging so as to make the reduction ratio equal to or greater than 2.3, it is possible to reduce the porosity to the same level as a level of rolled steel and to attain a required quality.

More specifically, ductility and toughness of the forging product is maintained at the same level as a product being produced by carrying out press forging in which a rolled steel is treated as the raw material.

Further, although the rolling process is not applied, porosities are removed to the same level as the case where a forging process is applied to rolled steel. Therefore, it is possible to form a product merely by the forging process without the application of a rolling process.

As a result, it is possible to reduce the costs required for the rolling process.

Furthermore, since the porosities are removed to the same level in the case that a rolled steel is used as the raw material, it is not necessary to define the region in which the porosities exist and to limit the useful portion of the products, unlike the case where a steel ingot is used as the raw material in the prior art. As a consequence, it is possible to remarkably improve the material yield.

Figure 9:
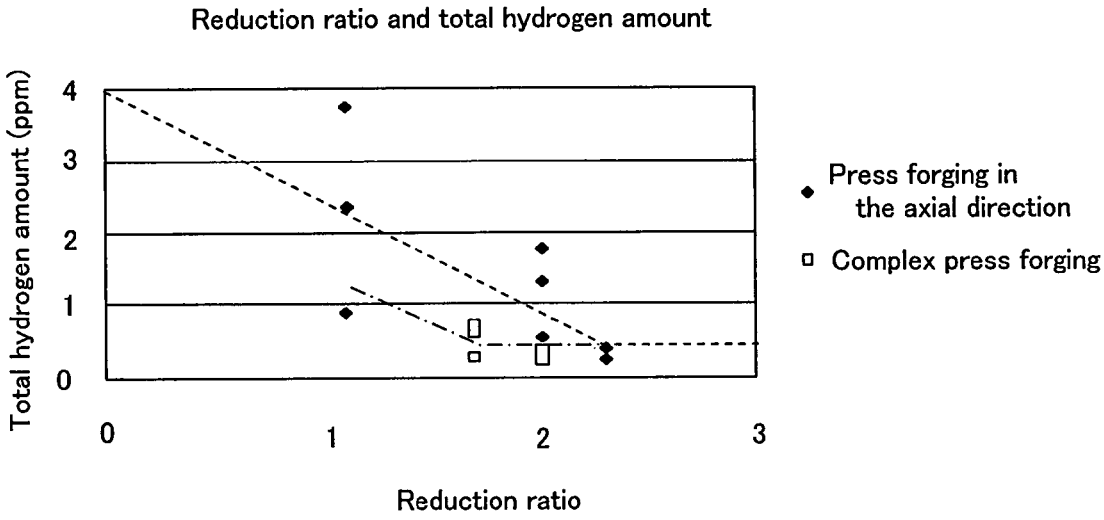
FIG. 9 is an another characteristic graph different from that shown in FIG. 7 showing a relationship between a reduction ratio and a total hydrogen amount.

FIG. 9 shows the result of an experiment which is different from the experiment shown in FIG. 7. In FIG. 9, as shown in FIG. 7, there is a relationship between the reduction ratio (a numerical value on the horizontal axis) and the total hydrogen amount (a numerical value on the vertical axis having a dimension of parts per million "ppm").

The experiment shown in FIG. 9 is carried out in the same manner as the cases that are described in reference to FIGS. 7 and 8.

In the experiment shown in FIG. 9, the total hydrogen amounts in test pieces, to which only press forging in the axial direction is carried out, is measured. Also, other total hydrogen amounts in other test pieces, to which press forging in the transverse direction (a forging ratio of 1.2) is applied, is measured. Thereafter, press forging in the axial direction (reduction ratios 1.7 and 2.0) is applied (in FIG. 9 and the present specification, a combination of the two types of press forging are described as "complex press forging").

In the case where press forging in the transverse direction is applied at the forging ratio of 1.2 and thereafter, press forging in the axial direction is applied at the reduction ratio of 1.7, it is obvious that the total hydrogen amount comes close to that of a rolled steel material by a comparison of FIGS. 9 and 7.

In other words, by applying the press forging in the transverse direction at the forging ratio of 1.2 and thereafter applying the press forging in the axial direction at the reduction ratio of 1.7, it is possible that the forging processes can be merely applied to a steel ingot in order to produce forging products without a rolling process. Thereby, it is possible to reduce costs related to the rolling process.

Further, since porosities are removed to the same level as the case where a rolled steel is treated as the raw material, it is not necessary to define the region in which porosities exist and to limit the useful portion of the product. As a consequence, it is also possible to improve the material yield.

Charpy impact values of the first test pieces (samples #1 to #3) and the second test pieces (samples #4 to #6) are shown in Table 1 below. The first test pieces were sampled from vicinities of an outer circumference of a roller being produced by the complex press forging in a case that press forging in a transverse direction is applied at the forging ratio of 1.2, and thereafter, press forging in an axial direction is applied at the reduction ratio of 1.7. The second test pieces were sampled from vicinities of an outer circumference of a roller being produced by press forging in a case that press forging is applied in an axial direction at the reduction ratio of 2.3.

TABLE 1

| | | | |
|---|---|---|---|
| Press forging in the axial direction | 25.0 | 22.5 | 26.25 |
| Complex press forging | 26.25 | 26.25 | 30.0 |

(Charpy impact value: $J/cm^2$)

When a Charpy impact value is measured, a test piece sampled from a vicinity of an outer circumference of a forged roller is completely quenched and tempered and then measured by means of a Charpy impact tester.

By the results shown in Table 1, the Charpy impact values of test pieces sampled from vicinities of an outer circumference of a roller produced by a complex press forging (a combination of a press forging in a transverse direction at the forging ratio of 1.2 and a press forging in an axial direction at the reduction ratio of 1.7) are substantially at the same level as the Charpy impact values of test pieces sampled from vicinities of an outer circumference of a roller produced by a press forging in an axial direction at the reduction ratio of 2.3. In other words, the toughness of a forging product produced by a complex press forging (a combination of a press forging in a transverse direction at the forging ratio of 1.2 and a press forging in an axial direction at the reduction ratio of 1.7) is substantially the same level as the toughness of a forged product produced by press forging in an axial direction at the reduction ratio of 2.3.

In the press forging method according to the above mentioned embodiment, it is merely required to keep the reduction ratio at a value of 2.3. It does not require a large reduction ratio (for example 4.0) as is required in the prior art. As a result, the costs for the forging process can be reduced to a lower level.

The second embodiment is explained with reference to FIGS. 10 to 12.

In the second embodiment, press forging in a transverse direction and press forging in an axial direction are applied consecutively. That is, a complex press forging process is applied.

Figure 12:
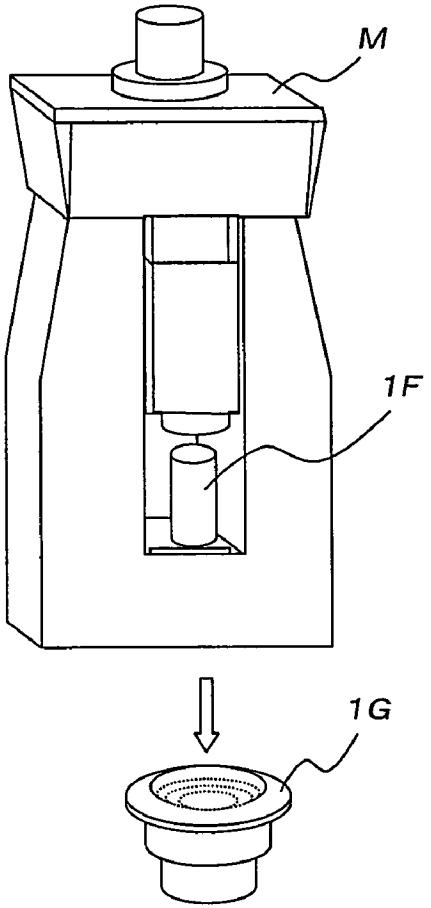
FIG. 12 is a view showing an axial press forging process in the second embodiment.
Figure 11:
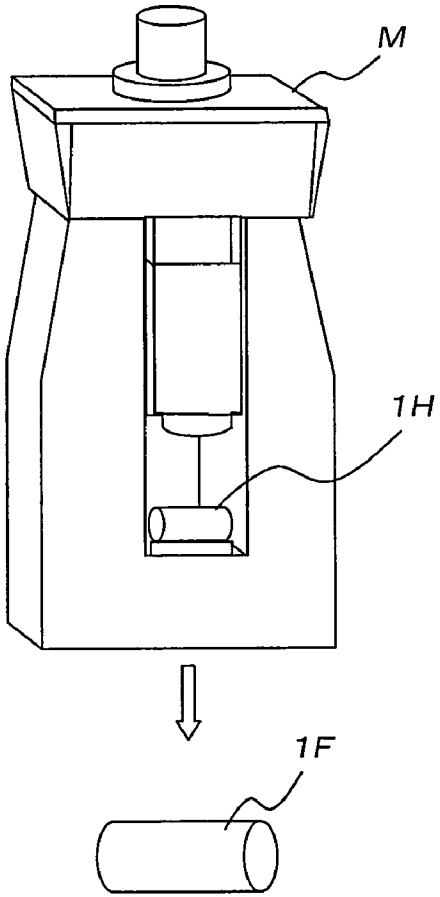
FIG. 11 is a view showing a transverse press forging process in the second embodiment.
Figure 10:
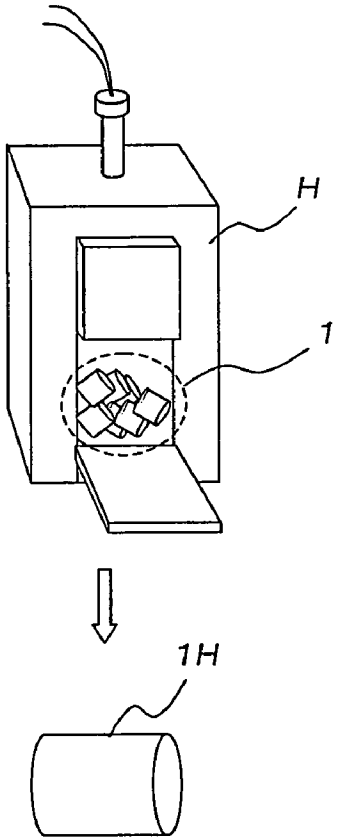
FIG. 10 is a view showing a heating process in a second embodiment according to the present invention.

In the second embodiment shown in FIGS. 10 to 12, press forging in a transverse direction is carried out at the forging ratio of 1.2, and thereafter, press forging in an axial direction is carried out at the reduction ratio of 1.7.

In the second embodiment as shown in FIG. 10, a round billet 1 having a round shape in cross section and a prescribed length is heated to a predetermined temperature by means of a heating furnace H. In FIG. 10, a round billet 1H (a round billet to which a forging process is not applied; and such round billet is treated as a raw material) is heated to a predetermined temperature in the heating furnace H.

Successively, in the process shown in FIG. 11, the round billet 1H is set laterally immediately after being heated (a situation that the horizontal axis is in a horizontal plane) in a press forging machine M. Then, a forging process (a press forging in the transverse direction) is applied to the round billet 1H by means of the press forging machine M. At this stage, the forging ratio is 1.2, for example.

The reference character 1F in FIG. 11 shows a round billet to which the press forging in the transverse direction is applied.

In the process shown in FIG. 12, the round billet 1F, to which the press forging in the transverse direction is applied, is set in the press forging machine M so as to make the direction of the axis of the raw material 1F in a vertical direction. Then, a press forging in the axial direction is applied by means of the press forging machine M. The reduction ratio at this stage is 1.7, for example.

The other process shown in FIG. 12 are the same as those in the process shown in FIGS. 2 to 5.

In FIG. 12 shows a raw material 1G (a forging product) to which a press forging in the axial direction is applied.

Figure 13:
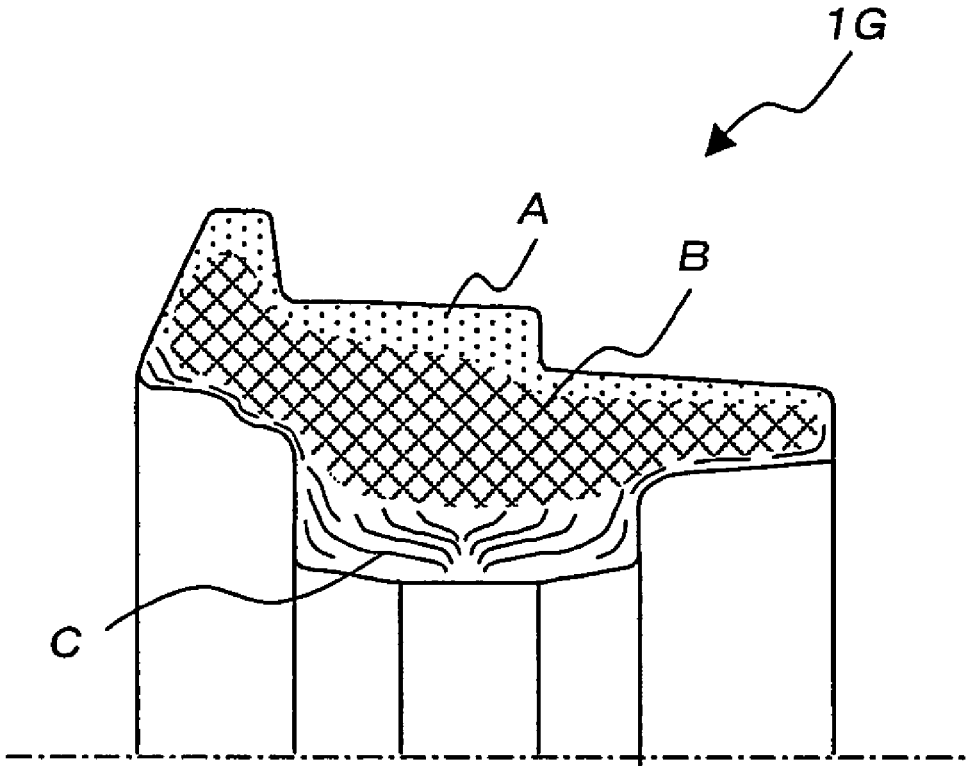
FIG. 13 is a sectional view explaining a macrostructure of the forgings produced in the second embodiment.

FIG. 13 shows a cross section of a forging product according to the second embodiment. Such cross section is prepared for a macrostructure and microstructure examination of the steel and for mechanical tests. That is, FIG. 13 shows the structure in the cross section of the forging product (the roller) 1G to which the complex press forging is applied.

In FIG. 13, an area A comprises a chilled structure. A chilled structure is a structure of a high purity that contains a scarce amount of impurity elements. Also, the chilled structure A has ductility and toughness identical to those of a rolled steel material.

An area represented by the reference character B in FIG. 13 is a dendrite structure. A dendrite structure is a structure after a casting process applied. In a forging process, a dendrite structure is not broken. Although a dendrite structure remains after the forging process, the functions of the roller can be maintained.

In FIG. 13, metal flows are shown with the lines C. In an area in which the metal flows C are generated, the porosities (voids) are crushed by a compression operation during the forging process. In other words, if the metal flows C are generated, a decrease in the mechanical strength because of the porosities is prevented.

This application is based on Japanese Patent Application No. 2006-325199 filed on Dec. 1, 2006, Japanese Patent Application No. 2007-027452 filed on Feb. 7, 2007 and Japanese Patent Application No. 2007-216655 filed on Aug. 23, 2007, the contents of which are incorporated hereinto by reference.

What is claimed is:

1. A press forging method comprising the steps of:

setting a cylindrical steel ingot onto a die as a raw material;

press forging the cylindrical steel ingot in a transverse direction where a forging ration of at least 1.2 is applied to the steel ingot, wherein the transverse direction indicates the press forging direction related to stretch forging, and the forging ratio equals a ratio of a cross section of a raw material before forging to a cross section of the raw material after forging; and thereafter, press forging in an axial direction where a reduction ratio of at least 1.7 is applied to the steel ingot, wherein the axial direction indicates a press forging direction related to upset forging, and the reduction ratio equals a ratio of a length of the raw material before forging to a length of the raw material after forging.

2. The press forging method according to claim 1, further comprising the step of press forging the steel ingot to produce a roller following the step of press forging in the axial direction.

* * * * *